US006600113B1

(12) United States Patent
Miller

(10) Patent No.: US 6,600,113 B1
(45) Date of Patent: Jul. 29, 2003

(54) DOOR EDGE SENSING SWITCH WITH MOVABLE WIRE SHEATH AND ADJUSTABLE ENDS

(75) Inventor: Bearge D. Miller, West Grove, PA (US)

(73) Assignee: Miller Edge, Inc., West Grove, PA (US)

( * ) Notice: Subject to any disclaimer, the term of this patent is extended or adjusted under 35 U.S.C. 154(b) by 0 days.

(21) Appl. No.: 10/232,185

(22) Filed: Aug. 29, 2002

(51) Int. Cl.[7] ..... H01H 3/16
(52) U.S. Cl. ..... 200/61.43; 200/61.7; 47/27
(58) Field of Search ..... 200/61.43, 61.42, 200/511, 86 A, 61.44, 61.7, 61.71, 61.73; 49/26, 27, 28

(56) References Cited

U.S. PATENT DOCUMENTS

| | | | | | |
|---|---|---|---|---|---|
| 2,740,856 | A | | 4/1956 | Doeg | |
| 3,133,167 | A | | 5/1964 | Miller | |
| 3,855,733 | A | | 12/1974 | Miller | |
| 3,867,595 | A | | 2/1975 | Ramsey et al. | |
| 4,019,004 | A | | 4/1977 | Gute | |
| 4,349,710 | A | | 9/1982 | Miller | |
| 4,369,344 | A | * | 1/1983 | Diamond | 200/61.43 |
| 4,396,814 | A | | 8/1983 | Miller | |
| 4,487,648 | A | | 12/1984 | Miller | |
| 4,908,483 | A | | 3/1990 | Miller | |
| 4,954,673 | A | | 9/1990 | Miller | |
| 5,418,342 | A | | 5/1995 | Miller | |
| 5,832,665 | A | * | 11/1998 | Miller et al. | 49/27 |
| 5,962,825 | A | * | 10/1999 | Miller | 200/61.43 |
| 6,172,315 | B1 | * | 1/2001 | Miller et al. | 200/61.73 |

* cited by examiner

*Primary Examiner*—Elvin Enad
*Assistant Examiner*—K. Lee
(74) *Attorney, Agent, or Firm*—Akin Gump Strauss Hauer & Feld, L.L.P.

(57) ABSTRACT

The present invention is a sensing edge for causing a closing door to open by actuating a device upon application of force to the sensing edge. The sensing edge, adjacent to a leading edge surface of the door and compressible upon application of external pressure, includes an elongate outer sheath with a first wall. The first wall and an inner wall, having a first aperture, define a first cavity. A top wall, having a plurality of top wall apertures, extends generally parallel to and is spaced from and secured to the inner wall, defining a second cavity. A sensor is positioned within the first cavity for detecting an external force applied to the sheath. At least one electrical conductor is in electrical communication with the sensor, extending through the first aperture, along the second cavity, and through any one of the top wall apertures for connection with the control device.

10 Claims, 4 Drawing Sheets

DOOR EDGE SENSING SWITCH WITH MOVABLE WIRE SHEATH AND ADJUSTABLE ENDS

BACKGROUND OF THE INVENTION

The present invention relates to a sensing edge, and more particularly, to a sensing edge that can be installed on a door with the conductors placed on the right or the left hand side of the door, either toward the end of the sensor or away from the end to allow for a cylinder lock, and that has extensions on the ends of the sheath that are capable of being trimmed to allow for a custom fit on the door.

Sensing edges for doors are generally well known. Such sensing edges generally include an elongated outer sheath in which a force sensing switch is positioned. Upon the application of force to the sheath, the force sensing switch actuates suitable control circuitry for controlling the movement of the door. The force sensing switch positioned within the sheath typically comprises a pair of flexible, spaced, electrically conducting sheaths positioned on the upper and lower sides of a layer of non-conducting foam having a plurality of openings extending therethrough from the upper to the lower side. Upon application of force to the sheath, either or both of the conductive sheaths are deflected into electrically conductive engagement with each other, to thereby complete an electrical connection and actuate suitable control circuitry for controlling the door.

Conventional sensing edges, including the above described force sensor, are not as versatile as that contemplated in the present invention. A common problem with conventional sensing edges is their difficulty of installation. Since the conductors exit the sheath through a fixed aperture that is located either on the end surface of the sheath or on the top edge of the sheath, the installer of the sensing edge must determine, before installation, whether he is working with circuitry that is going to be placed on the right hand side of the door, or on the left hand side. If the installer goes out to the job site and in the middle of an installation discovers that for some reason the control circuitry must be located on a different side of the door than was originally planned, he must then take the sensing edge that is currently in his possession and exchange it for another sensing edge which has the conductors placed on the other side. The reason for this is that since conductors generally exit the sheath from an end, the sensing edge is either a right-handed or left-handed edge.

Another common problem with conventional sensing edges is the inability to use a cylinder lock on doors upon which a sensing edge is installed. Because conductors exit the sheath through an aperture that it located either on the end surface of the sheath or on the top edge of the sheath, the conductors tend to obstruct the operation of a cylinder lock.

Yet another common problem with conventional sensing edges is the difficulty of custom fitting a conventional sensing edge to a door which may vary from a standard length. Unless the door is of a standard size, a custom order has to be placed in order to fit the door with a conventional sensing edge of a specific length.

The present invention is directed to a sensing edge for a door for sensing objects that come into contact with the sensing edge during door closing. The sensing edge in the present invention overcomes the problems inherent in the prior art. Multiple apertures are located in the top of the sheath so that the installer of the sensing edge can place the conductors through any one of the apertures. This results in increased versatility since it allows the installer to extend the conductors through the aperture position proximate either side surface of the door, making the sensing edge bilateral. The installer may also choose to extend the conductors through apertures located away from the ends of the sensing edge to allow for the use of a cylinder lock with the door. Also, extensions located on the ends of the sheath are capable of being trimmed right to the door guide, allowing a custom fit of the sensing edge to the door.

BRIEF SUMMARY OF THE INVENTION

Briefly stated, the present invention comprises a sensing edge for causing a closing door to open by actuating a device upon force being applied to the sensing edge. The door has a leading edge surface, a first lateral side surface, and a second lateral surface, the first and second lateral side surfaces being oppositely disposed and the door being mounted for movement through a range of motion. The sensing edge comprises an elongate outer sheath which is positioned adjacent to the leading edge surface of the door and is compressible upon application of external pressure. The sheath comprises a first wall including first and second oppositely disposed surfaces and first and second oppositely disposed ends. An inner wall extends proximate the first wall, being secured to the first wall such that the first wall and the inner wall define a first cavity. The inner wall has a first aperture extending therethrough. A top wall extends generally parallel to and spaced from the inner wall. The top wall is secured to the inner wall, the top wall and the inner wall defining a second cavity. The top wall has a plurality of top wall apertures extending therethrough. An elongate sensor is positioned within the first cavity for detecting an external force applied to the sheath. The sensor extends substantially along the entire length of the sheath between the first and second surfaces and between the first and second ends. At least one electrical conductor is in electrical communication with the sensor. The conductor extends through and is sealingly maintained within the first aperture. The conductor extends into the second cavity and is capable of extending through any one of the top wall apertures for connection with the device for controlling actuation of the door when the sensor detects application of force to the sheath.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
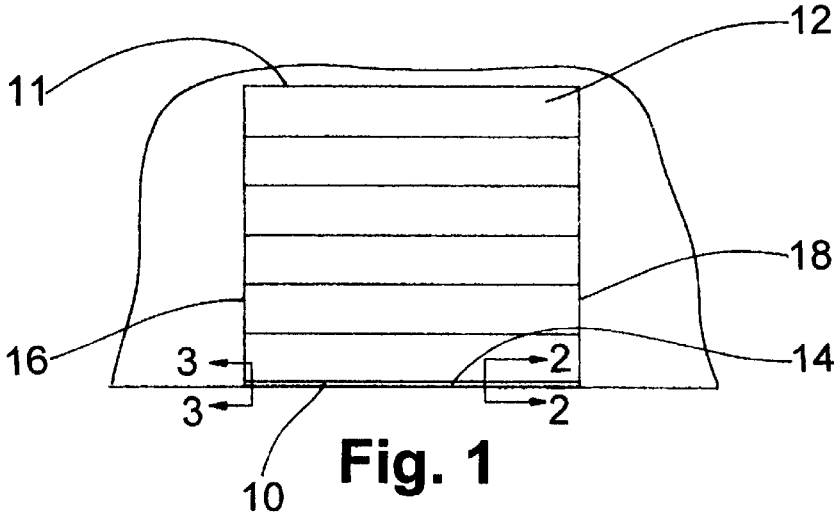
FIG. 1 is a front elevational view of a door construction including a sensing edge in accordance with a preferred embodiment of the present invention.

Certain terminology is used in the following description for convenience only and is not limiting. The words "right", "left", "upper", and "lower" designate directions in the drawings to which reference is made. The terminology includes the words above specifically mentioned, derivatives thereof and words of similar import.

Referring to the drawings in detail, wherein like numerals indicate like elements throughout, there is shown in FIGS. 1 through 6 a preferred embodiment of a sensing edge 10 in accordance with the present invention. There is shown in FIG. 1 a doorway 11 provided with a door 12. While the door 12, as illustrated, is an overhead door having a sensing edge 10 in accordance with the present invention along its lower side or leading edge surface 14, it is within the scope and spirit of the invention to incorporate the sensing edge 10 along the edge of any door structure, such as vertically disposed or horizontally movable doors (not shown) as desired. Moreover, it is understood by those skilled in the art that the sensing edge 10 is not limited to use in connection with only doors, but can be used for other applications, such as automatic windows and gates.

The door 12 has a leading edge surface 14, a first lateral side surface 16 and a second lateral side surface 18. The first lateral side surface 16 and second lateral side surface 18 extend generally parallel with respect to each other, and are oppositely disposed. The door 12 is movably mounted on a track (not shown) which guides the door 12 through a range of motion.

Figure 2:
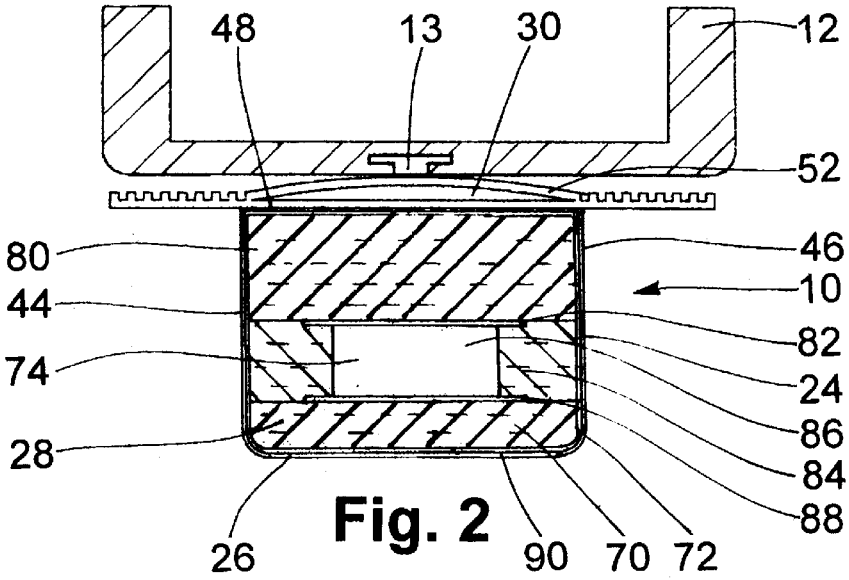
FIG. 2 is an enlarged cross-sectional view of a portion of the door and the sensing edge taken along line 2—2 of FIG. 1.

Referring to FIG. 2, the sensing edge 10 and the door 12 include securing means for fixing or attaching the sensing edge 10 to the leading edge surface 14 of the door 12. In the embodiment shown, the sensing edge 10 is secured to the door 12 via a securing member 13, which is T-shaped and extends outwardly from the sensing edge 10 and into a suitably shaped groove in the door 12. It will be appreciated that the securing member 13 may be secured within the suitably sized groove by use of a friction fit, adhesive substance or any other conventional securing means. Note that the sensing edge 10 may also be secured to the door 12 in any other suitable manner, for instance, with a traditional dovetail slot configuration (not shown) or using one of the configurations shown in U.S. Pat. No. 5,124,511. Moreover, it is also within the spirit and scope of the invention to secure the sensing edge 10 to the leading edge surface 14 of the door 12 by an adhesive (not shown) applied between the leading door edge surface 14 and the peripheral face of the sensing edge 10.

The sensing edge 10 is comprised of an elongate outer sheath 24 which is compressible upon application of external pressure. The sheath 24 forms a first wall 26 with a first cavity 28. The first wall 26 includes a first and second oppositely disposed surfaces, 44, 46. It is preferred that the sheath 24 have a generally constant cross-sectional outline, extending closely along the leading edge surface 14 of the door 12. In the present embodiment the sheath 24 is generally of rectangular cross-section, but it may be of any other suitable shape, such as circular or semi-circular (not shown). The securing member 13 is a T-shaped extension of the outer sheath 24, and extends generally in a direction away from the body of the sheath 24, so that the sensing edge 10 can be mounted in the door 12.

In the present embodiment, it is preferred that the sheath 24 be advantageously fabricated of a form-retaining, but flexible material, such as rubber. However, it is understood by those skilled in the art, that the sheath can be made of any form-retaining, flexible material, such as an elastomeric or other polymeric material.

The sensing edge 10 is secured to the leading edge surface 14 of the door 12 such that a first end 40 and the first side surface 16 of the door 12 are generally coplanar when the sensing edge 10 is positioned adjacent to the leading edge surface 14 of the door 12, and a second end 42 and the second side surface 18 of the door 12 are also generally coplanar when the sensing edge 10 is positioned adjacent to the leading edge surface 14 of the door 12.

In the preferred embodiment, the sensing edge 10 further includes an inner wall 48 that extends proximate the first wall 26, generally perpendicular to the first and second surfaces 44, 46. The inner wall 48 is sealingly engaged with the first wall 26 to entirely enclose the first cavity 28. The inner wall has a first aperture 50 extending therethrough.

Figure 5:
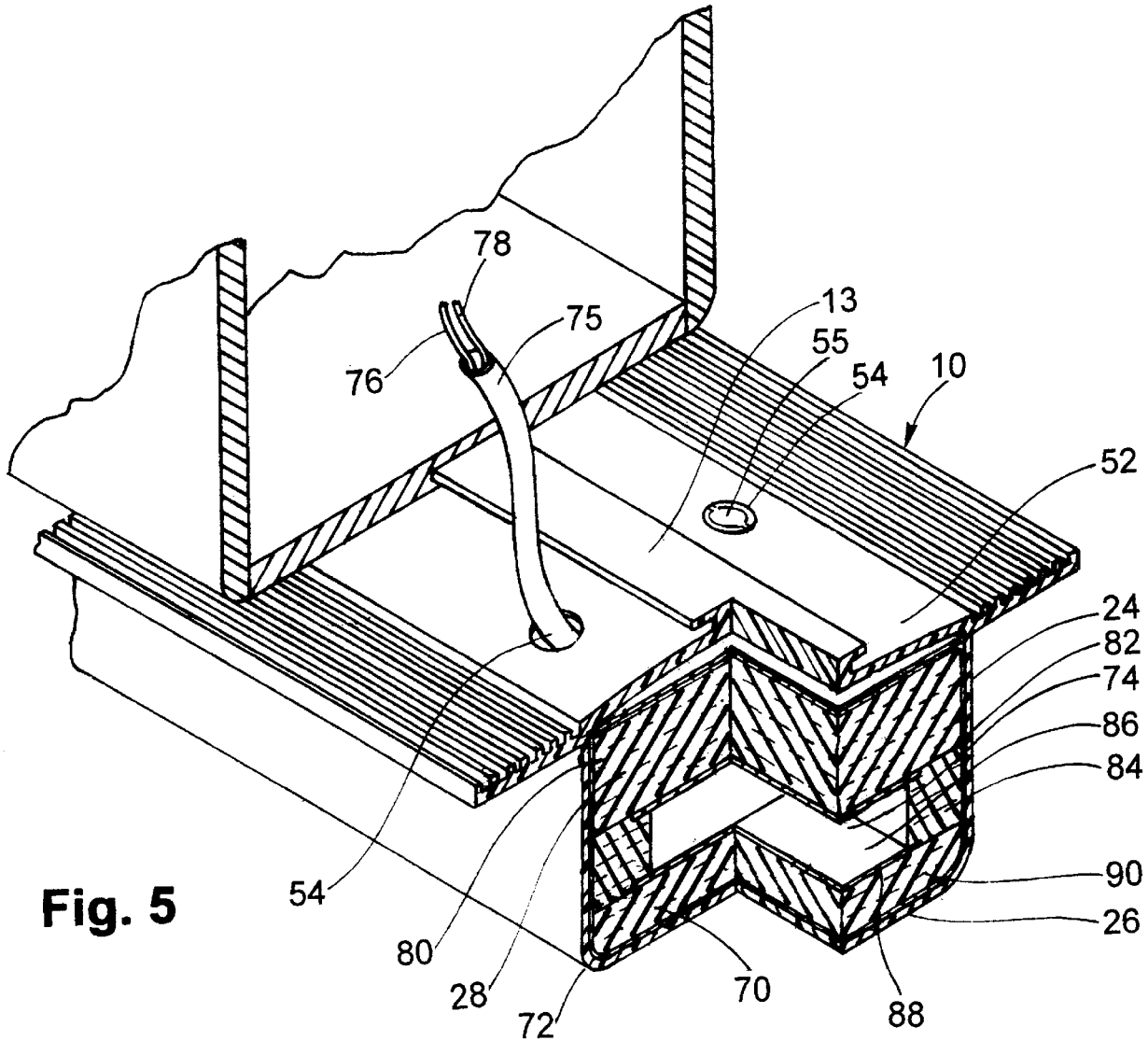
FIG. 5 is an enlarged partial perspective view of a cross-section of the sensing edge of FIG. 1.
Figure 6:
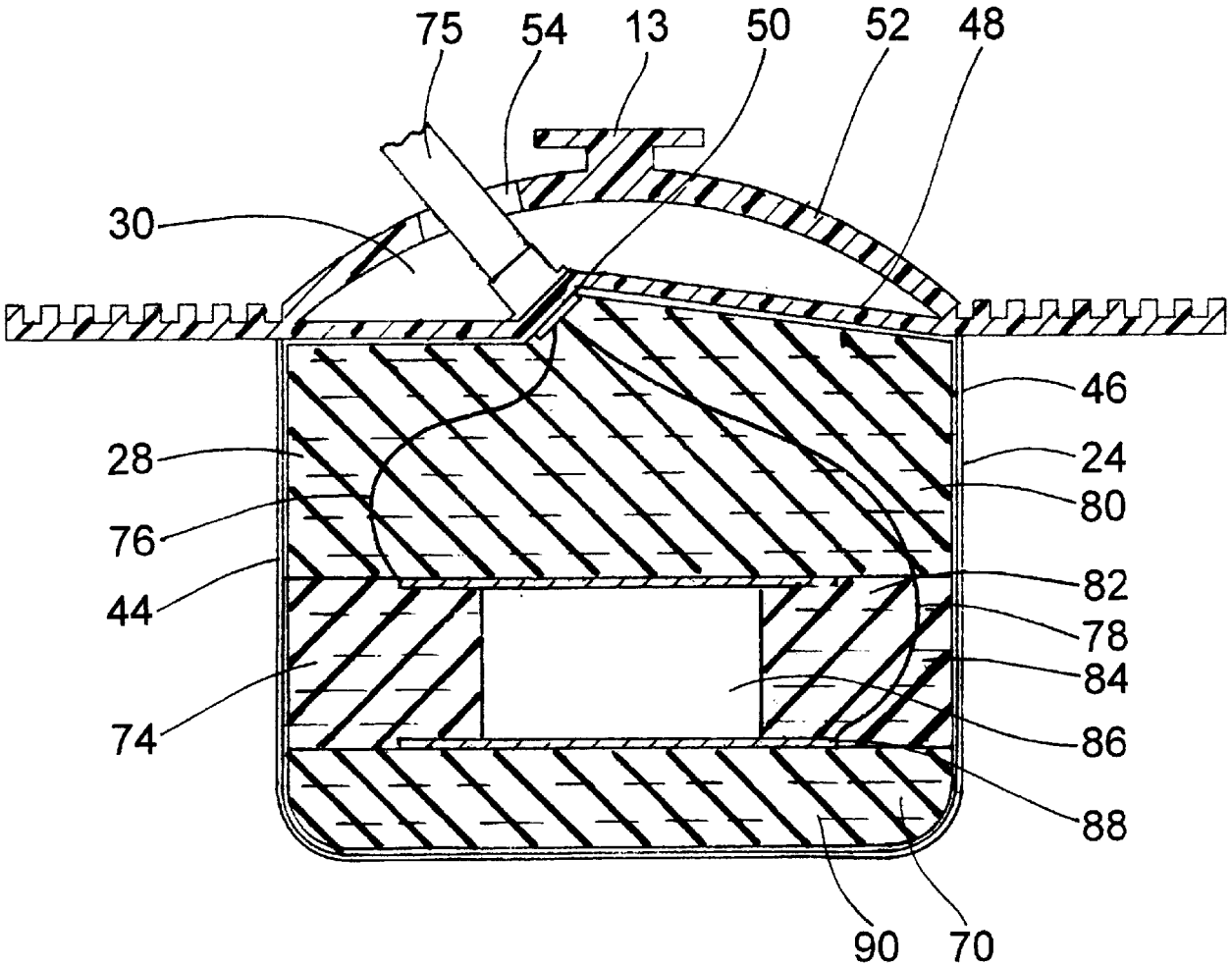
FIG. 6 is a is an enlarged cross-sectional view of a portion of the sensing edge taken along line 6—6 of FIG. 4*b*.

In the preferred embodiment, as best shown in FIGS. 5 and 6, the sensing edge 10 further includes a top wall 52, extending generally parallel to and spaced from the inner wall 48. The top wall 52 is secured to the inner wall 48 at the edges allowing the middle of the top wall 52 to be spaced from the middle of the inner wall 48, forming a second cavity 30 therebetween. The T-shaped extension 13 is secured to or forms a part of the top wall 52. The top wall 52 has a plurality of top wall apertures 54 extending therethrough.

In the present embodiment, it is preferred that the inner wall 48 and the top wall 52 be advantageously fabricated of a form-retaining, but flexible material, such as rubber. However, it is understood by those skilled in the art, that the inner wall 48 and the top wall 52 can be made of any form-retaining material, such as elastomeric or other polymeric material.

Figure 4A:
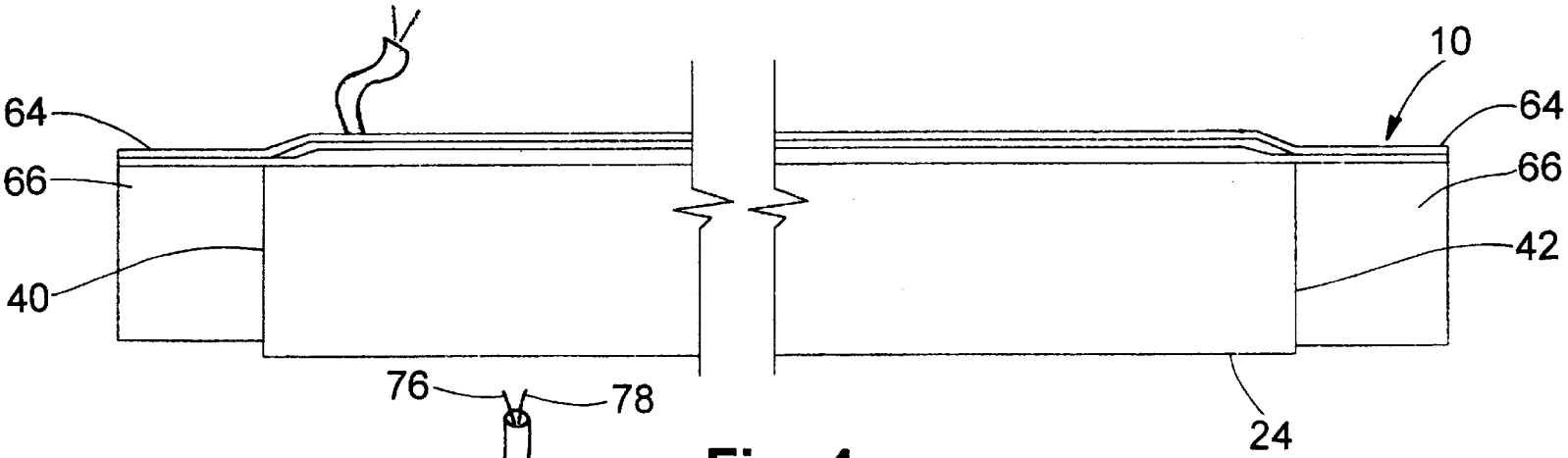
FIG. 4*a* is an enlarged side elevational view of the sensing edge of FIG. 1.
Figure 4B:
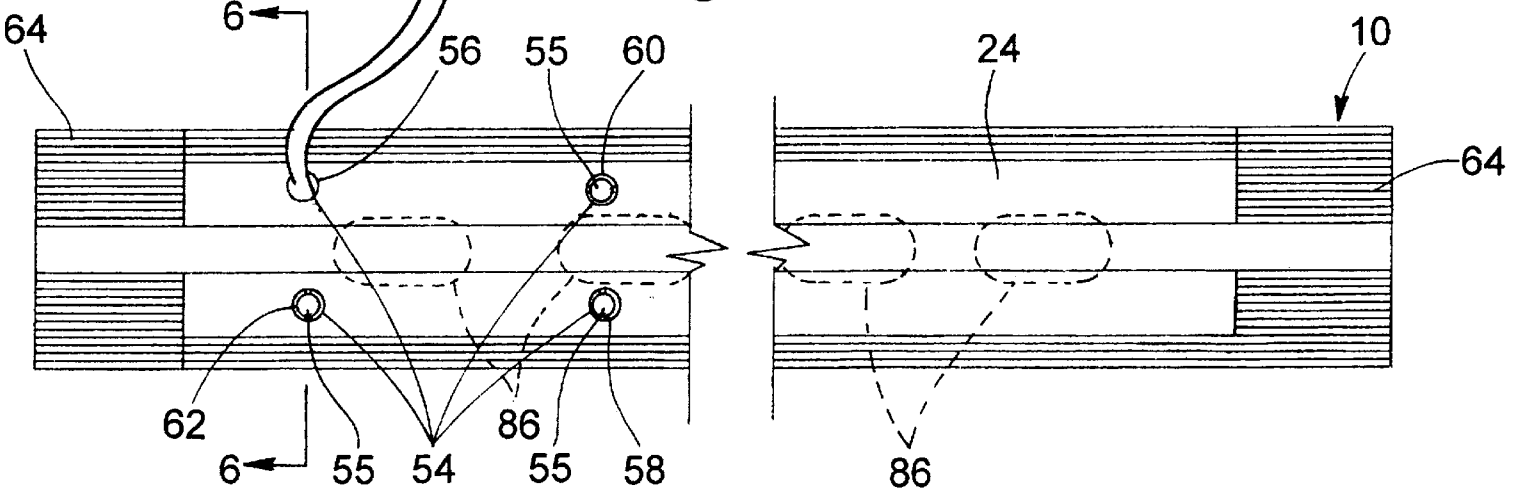
FIG. 4*b* is an enlarged top plan view of the sensing edge of FIG. 1.

Referring now to FIG. 4*b*, the top wall apertures 54 further include at least first and second top wall apertures 56, 58 located proximate to the first end 40. However, since certain garage door locks may interfere with the firsthand second top wall apertures 56, 58, additional top wall apertures 54 are desirable, including at least third and fourth top wall apertures 60, 62 located between the first and second top wall apertures 56, 58 and the second end 42. It is understood by those skilled in the art, that the number of top wall apertures 54 can be either more or less than that described above and that they can be spaced at any interval along the top wall 52.

Referring to FIGS. 4*a* and 4*b*, the sensing edge 10 further includes upper extension members 64. The upper extension members 64 are continuations of the top wall 52 that extend outwardly beyond the first and second ends 40, 42 of the sheath 24.

Figure 3:
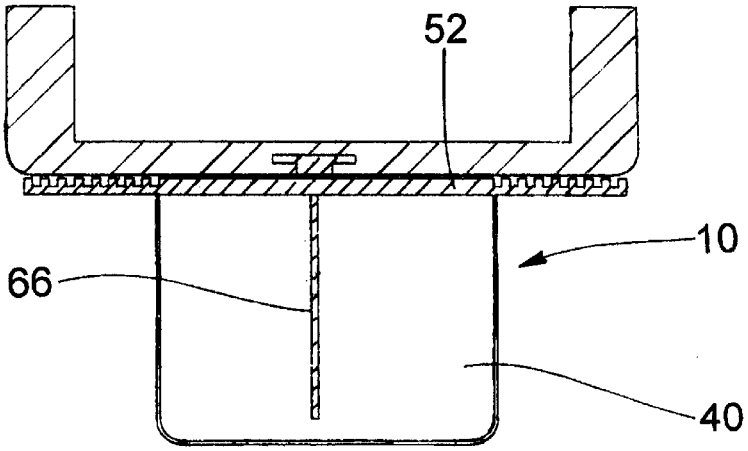
FIG. 3 is an enlarged cross-sectional view of a portion of the door and the sensing edge taken along line 3—3 of FIG. 1.

Referring now to FIGS. 3 and 4*a*, the sensing edge 10 further includes lower extension members 66 secured to and extending downwardly from the top wall 52 and secured to and projecting outwardly from both the first and second ends 40, 42 of the sheath 24. The lower extension members 66 are generally the same height as the sheath 24 to give the impression of a uniform height from one end of the sensing edge 10 to the other.

The presence of the upper extension members 64 and the lower extension members 66 allows the sensing edge 10 to be trimmed to fit the leading edge 14 of the door 12 to which the sensing edge 10 is connected. This allows the sensing edge 10 to be trimmed right to the door edge guide, making a custom fit. The upper and lower extension members 64, 66 extend outwardly from the first and second ends 40, 42 of the sheath 24 in such a way that, when trimmed, they do not interfere with the operation of the movement of the door 12 along the track 20 when the door 12 is opening or closing. It is also understood that the upper and lower extension members 64, 66, as shown in FIGS. 4*a* and 4*b*, are preferably constructed of the same material as the sheath 24. However, the present invention is not limited to constructing the upper and lower extension members 64, 66 to the same material as the sheath. The upper and lower extension members 64, 66 can be made of any suitable material in order to accommodate the particular requirements of the sensing edge 10 in a given installation. The upper and lower extension members 64, 66 do not interfere with the operation of the sensing edge 10.

Referring to FIGS. 2, 5, and 6, a sensor 70 runs the entire length of the sensing edge 10 from the first lateral side surface 16 to the second lateral side surface 18 within the first cavity 28. Through this construction, the sheath 24 protects the sensor 70 from exposure to the external elements. The sensor 70 substantially occupies the first cavity 28 of the sheath 24. In the preferred embodiment, the sensor 70 comprises a standard multi-layered force sensing switch 74 as described below.

In the preferred embodiment, the force sensing switch 74 comprises a first sheet of resiliently compressible material 80 which is positioned within the sheath 24 and includes a first face and a second face. The first face of the first sheet of resiliently compressible material 80 is in engagement or corresponding facing relationship with the inner wall 48. In the present embodiment, it is preferred that the first sheet of resiliently compressible material 80 and succeeding layers and sheets, described hereinafter, be generally sized to compliment the internal configuration of the sheath 24. However, it is understood by those skilled in the art, that the first sheet of resiliently compressible material 80 and succeeding layers can be sized as wide or as narrow as desired, and be virtually of any length for accommodating different structures and uses.

In the present embodiment, it is preferred that the first sheet of resiliently compressible material 80 be constructed of generally soft foam rubber. It is understood by those skilled in the art, that the first sheet of resiliently compressible material 80 can be constructed of either closed or open cell foam rubber or of other materials having similar properties.

Just below the first sheet of resiliently compressible material 80 is a first sheet of flexible, electrically conductive material 82, engaged therewith, and having a first and a second face. The first face of the first sheet of flexible, electrically conductive material 82 is in engagement or in corresponding facing relationship with the second face of the first sheet of resiliently compressible material 80.

In the present embodiment, it is preferred that the first sheet of flexible, electrically conductive material 82, be generally thin and preferably be constructed of aluminum or aluminum foil. However, it is within the spirit and scope of the invention, to construct the first sheet of flexible, electrically conductive material 82 of other materials, such as copper or brass.

As shown in FIG. 6, a first electrical conductor or wire 76 is electrically connected to the first sheet of flexible, electrically conductive material 82 preferably by soldering at one end thereof. The first electrical conductor 76 is used in conjunction with a circuit (not shown) for controlling the actuation of a device (described hereinafter) or door 12 as is understood by those skilled in the art, in response to the application of force to the sheath 24, as described hereinafter.

The first sheet of flexible, electrically conductive material 82 is in engagement with a layer of non-conductive material 84 having a first face and a second face for spacing apart the first sheet of flexible electrically conductive material 82 and a second sheet of flexible electrically conductive material 88, described hereinafter. The first face of the layer of non-conductive material 84 is in engagement or corresponding facing relationship with the second face of the first sheet of flexible, electrically conductive material 82.

The layer of non-conductive material 84 has at least one opening 86 extending therethrough between the first and second faces thereof. As shown in FIG. 6, the layer of non-conductive material 84 preferably includes a plurality of spaced openings 86 interspersed along the entire length thereof for allowing the actuation of the force sensing switch 74 by applying pressure thereto, as described hereinafter. In the present embodiment, it is preferred that the openings 86 be generally oval shaped in cross section. However, it is in the spirit and scope of the invention to configure the openings 86 of any geometric shape, such as square or circular.

The layer of non-conductive material is preferably constructed of generally soft foam rubber. It is understood by those skilled in the art, that the layer of non-conductive material 84 can be constructed of either closed or open cell foam or other materials having similar properties so long as the function of the force sensing switch 74 is achieved, as described hereinafter.

The layer of non-conductive material 84 is engagement with the second sheet of flexible, electrically conductive material 88 having a first face and a second face. The first face of the second sheet of flexible, electrically conductive material is in engagement or in corresponding facing relationship with the second face of the layer of non-conductive material 84.

In the present embodiment, it is preferred that the second sheet of flexible, electrically conductive material 88 be constructed of the same material and configuration as the first sheet of flexible, electrically conductive material 82. Similarly, the second sheet of flexible, electrically conductive material 88 is connected to a second electrical conductor or wire 78 for connection with a circuit for controlling the actuation of the door 12 or device in response to the application of force to the sheath 24.

In engagement with the second sheet of flexible, electrically conductive material 88 is a second sheet of resiliently compressible material 90 having a first face and a second face. The first face of the second sheet of resiliently compressible material 90 is in engagement or corresponding facing relationship with the second face of the second sheet of flexible, electrically conductive material 88. The second face of the second sheet of resiliently compressible material 90 engages the first wall 26 of the sheath 24.

The second sheet of resiliently compressible material 90 is preferably constructed of the same material and is configured generally identically to the first sheet of resiliently compressible material 80, except that it has a greater thickness. However, it is apparent to those skilled in the art, that the first and second sheets of resiliently compressible material 80, 90 can differ in configuration, size, and/or material.

In the preferred embodiment, a stopping block 68 is positioned within the sheath 24. The stopping block 68 is positioned within the first end 40 of the sheath 24. In the preferred embodiment, a second stopping block (not shown) is positioned proximate the second end 42 of the sheath 24. Because of the dual stopping block arrangement, the weight of the door 12 does not activate the sensor 70 when the door makes contact with the ground surface (not shown). That is, the weight of the door 12 in the closed position is borne by the stopping blocks 68 and not the sensor 70. It is appreciated by those skilled in the art that the stopping block 68 may be constructed of any non-compressible substance, such as hardened rubber, stiffened plastics, or synthetic resins. However, in order not to interfere with the operation of the sensor 70, the stopping block 68 is positioned within the sheath 24 such that it remains outside the sensing range of the sensor 70.

Referring to FIG. 6, the first and second electrical conductors 76, 78 exit the first cavity 28 through the first aperture 50 in the inner wall 48. The first and second electrical conductors 76, 78 are preferably sealingly maintained within the first aperture 50 so as to prevent damage to the sensor 70 from outside elements such as air, water and other liquids or solid material. It should be appreciated by those skilled in the art that other means for providing a sealed protective barrier for the sensor 70 are possible without departing from the spirit and scope of the invention.

Referring to FIGS. 4*b* and 6, in the present embodiment, the first and second electrical conductors 76, 78 can be routed through the second cavity 30 to any of the top wall apertures 54, through which the first and second electrical conductors 76, 78 can then exit the sensing edge 10. The electrical conductors 76, 78 are preferably housed within a casing 75 to facilitate feeding the electrical conductors 76, 78 through the above mentioned elements.

Referring now to FIG. 4*b*, the first and second top wall apertures 56, 58 are located proximate the first end 40 of the sheath 24. The distance of the first and second top wall apertures 56, 58 from the first end 40 may vary although about four inches is preferred. The third and fourth top wall apertures 60, 62 are located between the first and second top wall apertures, respectively, and the second end 42 of the sheath 24. Although the third and fourth top wall apertures 60, 62 can be located anywhere therebetween, a distance of 16 inches from the first end 40 is preferred. Although the preferred locations of the top wall apertures 54 are described above, it is within the spirit and the scope of the invention that the top wall apertures 54 be located at any distances from the first end 40 along the sensing edge 10.

In the present embodiment, it is preferred that the first aperture 50 be of a generally circular shape, so as to accommodate the usual forms of commercially available conductors or cabling. However, it is understood by those skilled in the art that the first aperture 50 can be shaped in any other suitable form, such as square, rectangular, or oval (not shown).

In the present embodiment, it is preferred that the top wall apertures 54 be of a generally circular shape so as to accommodate the usual forms of commercially available conductors or cabling. However, it is understood by those skilled in the art that the top wall apertures 54 can be shaped in any other suitable form, such as square, rectangular or oval (not shown).

In the present embodiment, it is preferred that aperture closures 55 are maintained within and are generally the same shape as the top wall apertures 54. Preferably, the aperture closures 55 are made from the same material as the top wall 52 and are created by partially punching out the top wall apertures 54 during manufacturing, leaving the aperture closures 55 engaged with the top wall 52 in at least one location. The aperture closures 55 are removable by tearing the engagements with the top wall 52. During installation of the sensing edge 10, the aperture closure 55 can be removed from the top wall aperture 54 through which the conductor 75 is to be routed, leaving the remaining top wall apertures 54 covered by their respective aperture closures 55 to assist in keeping foreign materials, such as water and dirt, outside of the sensing edge 10. It is understood by those skilled in the art that the aperture closures 55 can be engaged with the top wall 52 in more than one location. It is further understood that the aperture closures 55 can be manufactured separately from the top wall 52 of any suitable material and maintained within the top wall apertures 54 by any suitable means, such as with glue, adhesive, or friction.

In the present embodiment, it is preferred that the first and third top wall apertures 56, 60 be positioned such that they line up across from the second and fourth top wall apertures 58, 62 on opposite sides of a median longitudinal line extending along the center of the top wall 52. This arrangement provides the installer of this sensing edge 10 the greatest amount of flexibility when deciding which way to place the edge 10 along the door 12. For instance, if the conductor 75 were to be positioned along the first lateral side surface 16 of the door 12, then the conductor 75 would be fed through the second top wall aperture 58, or, if a cylinder lock is to be used with the door 12, the conductor 75 would be fed through the forth top wall aperture 62. Conversely, if the electrical conductor 75 were to be positioned along the second lateral side surface 18 of the door 12, then the conductor 75 would be fed through the first top wall aperture 56, or the third top wall aperture 60 if a cylinder lock is to be used.

It will be noted by those skilled in the art that the positioning that the first and second top wall apertures 56, 58 and the third and fourth top wall apertures 60, 62 opposite one another and separated by the median longitudinal line of the top wall 52 is not limiting. The top wall apertures 54 can be placed along any portion of the top wall 52 which is suitable for the particular installation of the sensing edge 10.

From the foregoing description, it can be seen that the present invention comprises a sensing edge 10 for causing a closing door 12 to open by actuating a device upon force being applied to the sensing edge 10. The sensing edge 10 of the present invention overcomes the problems inherent in the prior art by first, providing multiple top wall apertures 54 so that an installer of the sensing edge 10 can place the conductor 75 through any one of the top wall apertures 54, thus making the sensing edge 10 bilateral, and second, by providing upper and lower extension members 64, 66 on the first and/or second ends 40, 42 that may be trimmed right to the door guide allowing a custom fit.

In operation, the electrical conductors or wires 76, 78 are connected to a circuit (not shown) for controlling the actuation of a device (not shown) and/or for controlling the operation in response to the application of force to the sheath 24. Specifically, upon the application of force to the exterior surface of the sheath 24, a portion of at least one of the first and second sheets of flexible, electrically conductive material 82, 88 deflects into at least one of the openings 86 in the layer of non-conductive material 84 and makes electrical contact between the first and second sheets of flexible, electrically conductive material 82, 88 to thereby complete or enable the circuit to actuate the device and/or control the operation of the door 12.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A sensing edge for causing a closing door to open by actuating a device upon force being applied to the sensing edge, the door having a leading edge surface, a first lateral side surface, and a second lateral side surface, the first and second lateral side surfaces being oppositely disposed, the door being mounted for movement through a range of motion, the sensing edge comprising:

an elongate outer sheath, positioned adjacent to the leading edge surface of the door and compressible upon application of external pressure, the sheath including a first wall including first and second oppositely disposed surfaces and first and second oppositely disposed ends;

an inner wall extending proximate the first wall, the inner wall being secured to the first wall, the first wall and the inner wall defining a first cavity, the inner wall having a first aperture extending therethrough;

a top wall extending generally parallel to and spaced from the inner wall, the top wall being secured to the inner wall, the top wall and the inner wall defining a second cavity, the top wall having a plurality of top wall apertures extending therethrough;

an elongate sensor positioned within the first cavity for detecting an external force applied to the sheath, the sensor extending substantially along the entire length of the sheath between the first and second surfaces and between the first and second ends; and at least one electrical conductor in electrical communication with the sensor, the conductor extending through and being sealingly maintained within the first aperture, the conductor extending into the second cavity and being capable of extending through any one of the top wall apertures for connection with the device for controlling actuation of the door when the sensor detects application of force to the sheath.

2. The sensing edge as recited in claim 1, wherein the plurality of top wall apertures includes at least first and second top wall apertures located proximate to the first end and third and fourth top wall apertures located between the first and second top wall apertures and the second end.

3. The sensing edge as recited in claim 1, wherein the top wall includes upper extension members which extend beyond the first and second ends of the sheath.

4. The sensing edge as recited in claim 3, wherein the sensing edge has lower extension members projecting outwardly from both the first and second ends of the sheath, the lower extension members being secured to the upper extension members, whereby, upon installation of the sensing edge on the leading edge surface, the upper and lower extension members are capable of being trimmed to fit the leading edge of the door to which the sensing edge is installed.

5. The sensing edge as recited in claim 1 wherein the at least one electrical conductor comprises first and second electrical conductors in a common protective shield and the sensor comprises:

a first sheet of resiliently compressible material having a first face and a second face, the first face of the first sheet of resiliently compressible material being in engagement with the wall of the sheath;

a first sheet of flexible, electrically conductive material having a first face and a second face, the first face of the first sheet of flexible, electrically conductive material being in engagement with the second face of the first sheet of resiliently compressible material, the first sheet of flexible, electrically conductive material being connected with the first electrical conductor;

a layer of non-conductive material having a first face and a second face, the first face of the layer of non-conductive material being in engagement with the second face of the first sheet of flexible electrically conductive material, the layer of non-conductive material including at least one opening extending therethrough between the first and second faces thereof;

a second sheet of flexible, electrically conductive material having a first face and a second face, the first face of the second sheet of flexible, electrically conductive material being in engagement with the second face of the layer of non-conductive material, the second, sheet of flexible, electrically conductive material being connected with the second electrical conductor;

a second sheet of resiliently compressible material having a first face and a second face, the first face of the second sheet of resiliently compressible material being in engagement with the second face of the second sheet of flexible, electrically conductive material, the second face of the second sheet of resiliently compressible material being in engagement with the wall of the sheath, the first and second sheets of flexible, electrically conductive material being spaced apart by the layer of non-conductive material and presenting opposed portions to each other through the opening whereby upon the application of force to the sheath, a portion of at least one of the first and second sheets of flexible, electrically conductive material deflects into the opening in the layer of non-conductive material and makes electrical contact between the first and second sheets of flexible, electrically conductive material, to thereby actuate the device.

6. A sensing edge for causing a closing door to open by actuating a device upon force being applied to the sensing edge, the door having a leading edge surface, a first lateral side surface, and a second lateral side surface, the first and second lateral side surfaces being oppositely disposed, the door being mounted for movement through a range of motion, the sensing edge comprising:

an elongate outer sheath, positioned adjacent to the leading edge surface of the door and compressible upon application of external pressure, the sheath including a first wall defining a first cavity, the first wall including first and second oppositely disposed surfaces and first and second oppositely disposed ends;

a top wall extending proximate the first wall and being secured to the inner wall, the top wall including upper extension members which extend beyond the first and second ends of the sheath;

lower extension members projecting outwardly from both the first and second ends of the sheath and secured to the upper extension members, whereby, upon installation, the upper and lower extension members can be trimmed to fit the leading edge of the door upon which the sensing edge is installed;

an elongate sensor positioned within the first cavity for detecting an external force applied to the sheath, the sensor extending substantially along the entire length of the sheath between the first and second surfaces and between the first and second ends; and at least one electrical conductor in electrical communication with the sensor for connection with the device for controlling actuation of the door when the sensor detects application of force to the sheath.

7. The sensing edge as recited in claim 6, wherein the sheath has a first aperture extending therethrough.

8. The sensing edge as recited in claim 7, wherein the top wall has a plurality of top wall apertures extending therethrough.

9. The sensing edge as recited in claim 8, wherein the conductor is sealingly maintained within the first aperture and is capable of extending through any one of the top wall apertures.

10. The sensing edge as recited in claim 6, wherein the at least one electrical conductor comprises first and second electrical conductors in a common protective shell and the sensor comprises:

a first sheet of resiliently compressible material having a first face and a second face, the first face of the first sheet of resiliently compressible material being in engagement with the wall of the sheath;

a first sheet of flexible, electrically conductive material having a first face and a second face, the first face of the first sheet of flexible, electrically conductive material being in engagement with the second face of the first sheet of resiliently compressible material, the first sheet of flexible, electrically conductive material being in electrical communication with the first electrical conductor;

a layer of non-conductive material having a first face and a second face, the first face of the layer of non-conductive material being in engagement with the second face of the first sheet of flexible, electrically conductive material, the layer of non-conductive material including at least one opening extending therethrough between the first and second faces thereof;

a second sheet of flexible, electrically conductive material having a first face and a second face, the first face of the second sheet of flexible, electrically conductive material being in engagement with the second face of the layer of non-conductive material, the second sheet of flexible, electrically conductive material being in electrical communication with the second electrical conductor;

a second sheet of resiliently compressible material having a first face and a second face, the first face of the second sheet of resiliently compressible material being in engagement with the second face of the second sheet of flexible, electrically conductive material, the second face of the second sheet of resiliently compressible material being in engagement with the wall of the sheath, the first and second sheets of flexible, electrically conductive material being spaced apart by the layer of non-conductive material and presenting opposed portions to each other through the opening whereby upon the application of force to the sheath, a portion of at least one of the first and second sheets of flexible, electrically conductive material deflects into the opening in the layer of non-conductive material and makes electrical contact between the first and second sheets of flexible, electrically conductive material, to thereby actuate the device.

* * * * *